US005508668A

United States Patent [19]

Prokkola

[11] Patent Number: 5,508,668

[45] Date of Patent: Apr. 16, 1996

[54] HELIX RESONATOR FILTER WITH A COUPLING APERTURE EXTENDING FROM A SIDE WALL

[75] Inventor: Risto Prokkola, Lumijoki, Finland

[73] Assignee: LK-Products Oy, Kempele, Finland

[21] Appl. No.: 225,378

[22] Filed: Apr. 8, 1994

[30] Foreign Application Priority Data

Apr. 8, 1993 [FI] Finland ..... 931621

[51] Int. Cl.[6] ..... H01P 1/201; H01P 7; H01P 00

[52] U.S. Cl. ..... 333/202; 333/219

[58] Field of Search ..... 333/202, 208, 333/212, 227, 230, 239, 248, 219; 29/600

[56] References Cited

U.S. PATENT DOCUMENTS

| | | | |
|---|---|---|---|
| 3,070,873 | 1/1963 | Gordon et al. | 29/600 |
| 3,621,484 | 11/1971 | Shult | 333/202 |
| 3,925,883 | 12/1975 | Cavalear | 29/600 |
| 4,251,787 | 2/1981 | Young et al. | 333/212 X |
| 4,490,699 | 12/1984 | Yanagida | 333/202 |
| 4,652,844 | 3/1987 | Brambilla | 333/212 |
| 5,157,363 | 10/1992 | Puurunen et al. | 333/202 |

FOREIGN PATENT DOCUMENTS 87405 8/1991 Finland ..... H01P 1/20

OTHER PUBLICATIONS

Patent Abstracts of Japan, vol. 7, No. 103 (E–173) (1248)) May 6, 1983, showing JP–A–58 024 201 (Fujitsu K.K.) Feb. 14, 1983, 1 page.

*Primary Examiner*—Benny Lee
*Assistant Examiner*—Justin P. Bettendorf
*Attorney, Agent, or Firm*—Darby & Darby

[57] ABSTRACT

In the housing of a filter realized with helix resonators, it is known to locate a coupling aperture in the partition between the resonators. According to the invention, the aperture in the partition is made so that outside the housing a milling cutter (33) is positioned at the point of the wall (31) of the housing where the partition (32) joins the wall of the housing. The longitudinal axis of the cutter extends in the plane of the partition. Then the cutter (33) is forced into the housing to a desired depth (H), whereby the cutter cuts an aperture in the partition open end at the housing surface, the aperture having a width equal to the width of the cutter and a height equal to the distance (H) the cutter was pushed. In this way it is easy to make coupling apertures also in extremely small sized filters, which are lower than 5 mm.

3 Claims, 3 Drawing Sheets

HELIX RESONATOR FILTER WITH A COUPLING APERTURE EXTENDING FROM A SIDE WALL

This invention relates to a method of making a coupling aperture in the partition between the resonators in a radio frequency filter comprising at least two helix resonators, through which aperture the resonators are mutually coupled by an electromagnetic field in the desired way.

BACKGROUND OF THE INVENTION

A helix resonator or a helix is a transmission line resonator with a physical length of about one quarter of a wave length. It is well known to use a helix resonator as a tuning element and it is widely used in filters in the high frequency band, particularly at 100 to 1000 MHz. A resonator of this kind comprises inductive elements; a conductor wound to a helical coil and a metallic housing at a distance from the coil. The low impedance (grounded) end of the coil is usually connected directly to the metallic housing. The opposite end, the high impedance end of the coil is separated from the housing and capacitively coupled to it. A connection to the resonator can be made in a known way by soldering a signal conductor directly to the helix coil, usually to the first turn of the coil. This connecting point determines the impedance level of the resonator, and thus the resonator can be matched to the rest of the circuit by the selection of this point. This matching, in which the connection point forms a tap of the resonator coil, is called tapping and this point is called the tapping point. The tapping point can be calculated or determined experimentally.

The characteristic impedance of a helix resonator is determined by the ratio of the diameter of the coil to the inside dimension of the housing surrounding the coil, by the mutual distance of the turns in the coil or the so called pitch, and by any dielectric material used as a support for the resonator. The resonance frequency of a helix resonator is a function of the physical dimension of the coil, of the capacitive structure, and of the distance between the high impedance end and the housing. Thus an accurate and exact design is required to manufacture a resonator with a specified frequency band.

A filter can be manufactured by placing several helix resonators in the same housing. A compartment housing can be used to control the electromagnetic coupling between adjacent resonators, in other words, each resonator is placed in its own compartment so that there is a partition of the housing between adjacent resonators. When an aperture, a so called coupling aperture is made in the partition so that the aperture has a defined size and a defined position, we obtain the desired coupling factor k between the resonators which indicates how much electromagnetic energy passes through the partition aperture from one resonator to the other.

FIG. 1 is a simplified representation of a filter housing having a coupling aperture in a partition. FIG. 1 shows in a simplified way the housing 1 of a filter realized with helix resonators, the housing comprising a cover 2, side surfaces 3 and end surfaces. The bottom of the housing is open and the cylindrical coils are mounted in the housing through its bottom. In this example the housing has three partitions 4, 5, 6, which divide the internal space into four compartments c1, c2, c3 and c4. At least one partition, the partition 4 in the figure, has a coupling aperture 7.

FIG. 2 shows how the coupling aperture is made in accordance with the prior art. In the current production filters the coupling apertures are located in the centre of the partition and according to FIG. 2 made with aperture tools comprising a die and a cushion. According to the figure showing a filter as seen from one side, the aperture tool is put inside the filter housing via the open bottom of the multi-compartment filter housing 21 so that the partition 22 remains between the die 23 and the cushion 24. Then the die is forced against the cushion, whereby an aperture is cut in the partition, the aperture being e.g. in accordance with the aperture 7 of FIG. 1.

An advantage of this known way to make an aperture is that the use of the same tool always produces an aperture of the same size and in the same place, which means good reproducibility. Further in a cutting line, which is a series of consecutive operations by which the filter housing is mechanically processed, the aperture making step is rather short.

The disadvantage of this known way to make an aperture is above all that a new die and cushion have to be made for different aperture sizes. The tool is manufactured by wire quenching of an annealed billet, thus it is a slow and expensive operation to make a new die and cushion. Secondly, as the filter size decreases, e.g. to filters lower than 4 mm, it is questionable whether it is possible to make apertures with this aperture tool method at all. This is because the durability of the tool becomes a problem as, in order to make a functional tool, the dies and cushions must be so thin and narrow that they can not withstand the stresses caused by cutting in mass production and fail. The fracture positions are shown in FIG. 2 by wave lines a and b.

SUMMARY OF THE INVENTION

In accordance with the first aspect of the invention there is provided a method for making a coupling aperture in a partition between compartments of a filter housing suitable for receiving helix resonators, the method comprising, advancing a cutter into the housing so that the longitudinal axis of the cutter extends in the plane of the partition so as to produce an aperture having one dimension defined by the width of the cutter and a transverse dimension defined by the distance by which the cutter is advanced.

The first aspect of the invention provides a method which alleviates the above presented disadvantages associated with making the coupling aperture by the known method. The method has the advantage of being applicable to the manufacturing of extremely small sized filters. In addition it allows conventional tools to be used and enables apertures of different sizes to be made.

The inventive method is suitable for use in extremely small filter housings (lower than 4 mm). It is easy to change the size of the coupling aperture both in the direction of the breadth and the height e.g. by changing the cutter or by changing the depth of the cut, and there is no risk of damage to the tool. Conventional cutting machinery already available by filter manufacturers is well suited to be used in the method, so that tool maintenance costs will be low. The applicability to mass production is also excellent. It is possible to save in product design costs, and the maintenance costs of the known aperture tool are completely counted off, because it is not necessary to make a separate aperture tool or die and cushion for a particular housing.

The step of advancing the cutter may be repeated with the cutter positioned to advance into the housing at a position adjacent the aperture to increase the dimension of the coupling aperture. This enable a thinner cutter to be used which is first forced to a desired depth and then moved in the direction of the partition plane in order to obtain an aperture with the desired width.

The housing may be box-like comprising an upper face and first and second side faces transverse thereto, the partition extending between these faces. An aperture can then be cut either through the upper face or through the side faces.

The aperture is preferably cut through the upper face as electrically it is preferable for the aperture to open at the upper face as it is more difficult to electrically control an aperture when it opens at a side face in an asymmetric relation to the longitudinal axis of the helix resonator.

In accordance with a second aspect of the invention there is provided a radio frequency filter comprising, a housing having a partition for dividing the housing into compartments, the partition extending between outer walls of the housing, and a respective helix resonator disposed in each of the compartments, the partition having a coupling aperture extending in a first direction from the outer wall of the housing, the outer wall having a corresponding aperture having the same dimension in the plane of the partition as the greatest extent of the coupling aperture in a direction transverse to the first direction.

Thus the coupling aperture is open ended at the edge of the partition, so that the edge of the aperture is level with the outer surface of the housing.

The aperture could be made using cutting, boring, immersion or wire quenching as well as by utilising the method according to the first aspect of the invention.

Electrically it is preferable for the aperture to open at the cover surface of the filter housing, because it is more difficult for an aperture to be electrically controlled when it opens at the side of the cover in an asymmetric relation to the longitudinal axis of the helix resonator.

BRIEF DESCRIPTION OF THE DRAWINGS

The invention will now be described in greater detail with reference to FIGS. 3 to 6 of the drawings of which.

DETAILED DESCRIPTION OF THE INVENTION

Figure 4:
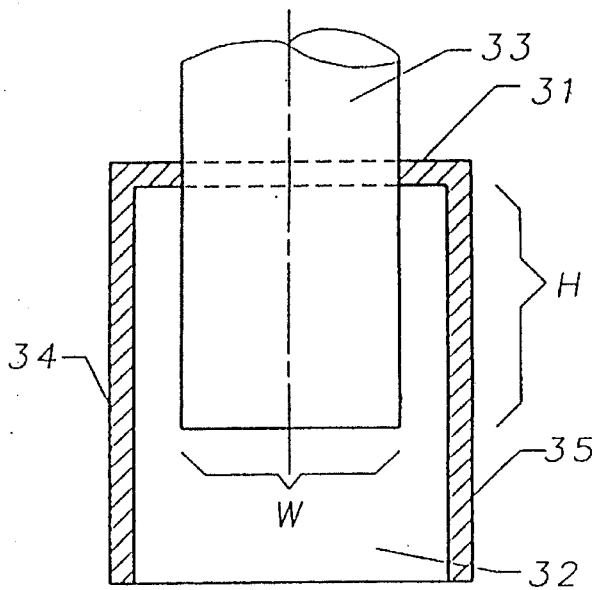
FIG. 4 shows the situation of FIG. 3B as seen in the direction normal to the partition surface.
Figure 3B:
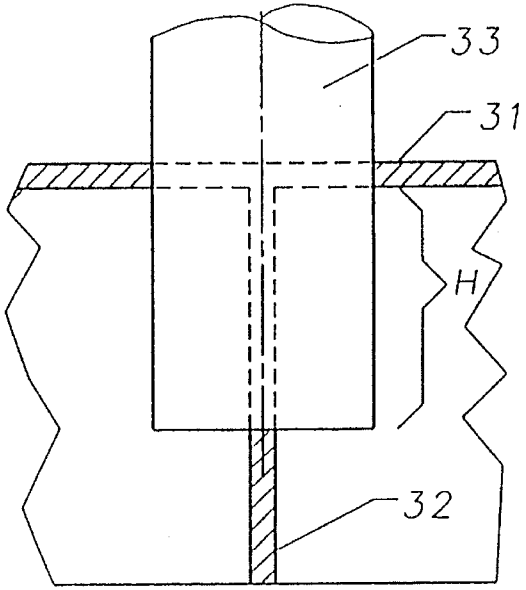
FIGS. 3A and 3B show the steps of making the coupling aperture as seen in the direction of the partition plane.
Figure 3A:
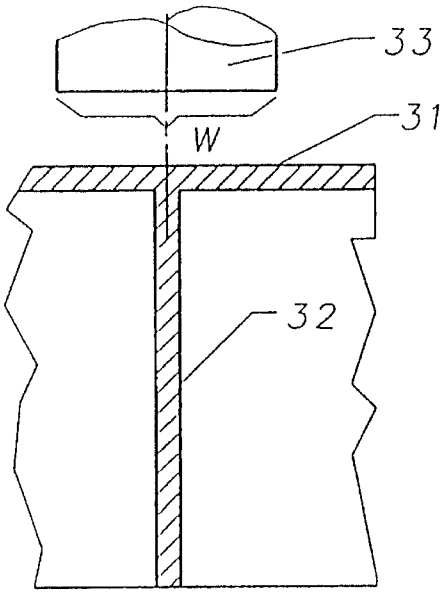

FIG. 3A, which shows the housing in section as seen from one side, represents the operation step immediately before an aperture is made in a partition 32 of the filter housing. The housing rests against a suitable bed (not shown) and the cutter 33 is on the cover 31 of the housing. The width of the cutter equals the desired width of the aperture, and the longitudinal axis of the cutter extends in the plane of the partition. The axis of the cutter 33 extends in the transverse direction through the longitudinal central axis of the cover, and thus at equal distances from the side walls 34 and 35 of the housing, as is shown in FIG. 4. Then the cutter is forced against the cover 31, the cutter making first a round hole in the cover. The cutter continues its forward movement and cuts material from the partition 32. The forward cutting is advanced so far that the cutter in the partition reaches the depth H from the level of the cover 31. This is the desired depth of the coupling aperture and the cutting is finished at this stage. The extreme position of the cutter is shown in FIG. 3B.

It must be observed that the description relating to FIGS. 3A and 3B also applies when the aperture is cut from the side of the housing. Then the cover 31 must be understood to be the side of the housing.

In FIG. 4, showing the situation of FIG. 3B as seen in the direction normal to the partition surface, it can clearly be seen that the cutter produced in the partition an aperture with a width W and a height H. A coupling aperture of a desired size is obtained by changing the cutter diameter and/or the depth to which it is forced. Of course the cutter makes an opening which remains in the cover 31, but its effect on the electrical properties of the filter is negligible.

Figure 5:
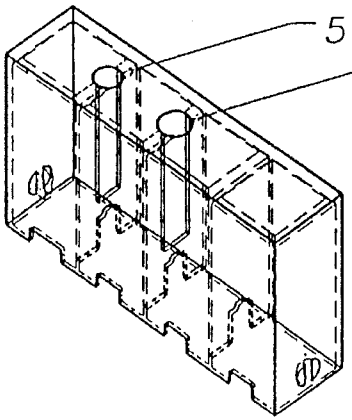
FIG. 5 shows a filter housing according to the invention.

FIG. 5 shows in a perspective view a finished filter housing as seen obliquely from above. A circular opening 51, 52 can be seen in those places where a coupling aperture is made in a partition in the way described above.

Figure 6:
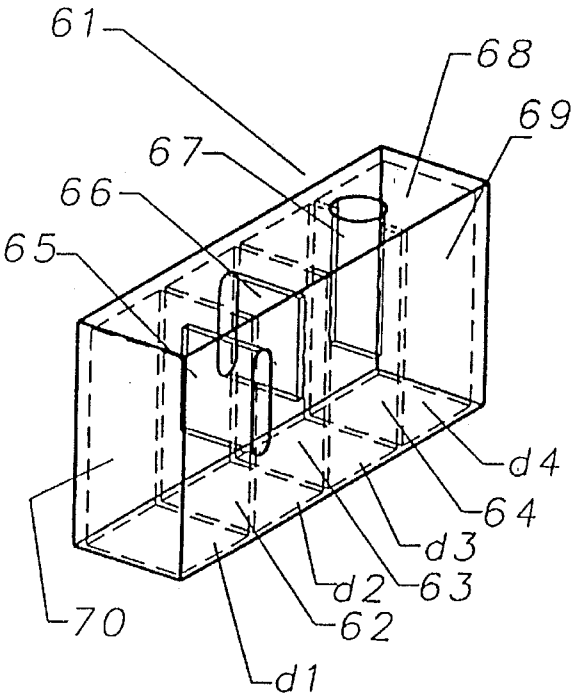
FIG. 6 shows various different apertures.
Figure 2:
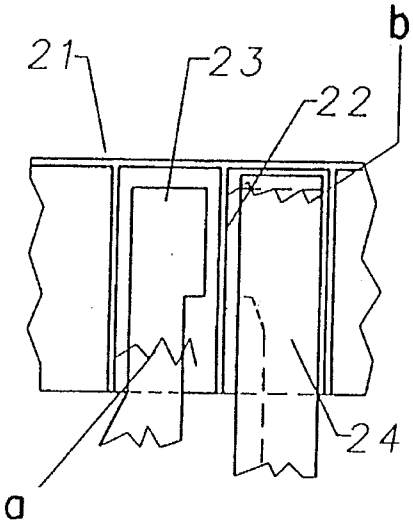
Fig.2 (Prior Art)
FIG. 2 is a schematic representation of a side view of a conventional filter.
Figure 1:
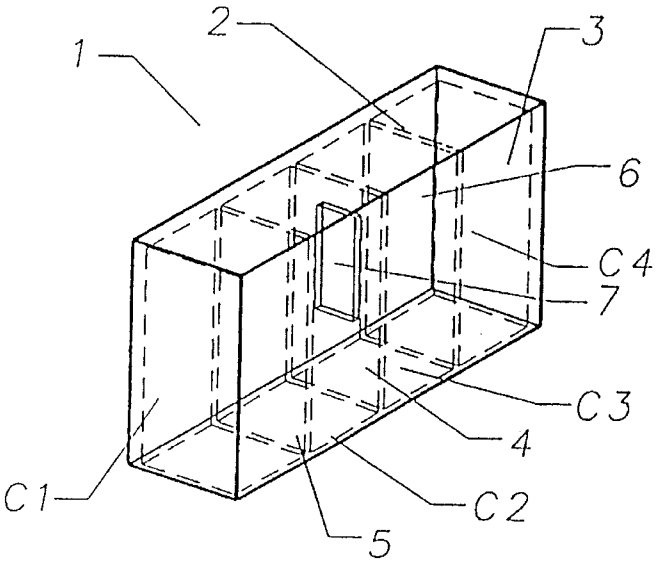
Fig.1 (Prior Art)
FIG. 1 is a perspective view of a conventional filter housing.

FIG. 6 shows a filter housing 61 for a four circuit filter realized with helix resonators, the housing having partitions 62, 63 and 64 provided with apertures 65, 66 and 67. As can be seen, the aperture 67 opens in the cover 68 of the housing, whereas the apertures 66 and 67 are made by cutting through the side surface 69 or 70 of the housing.

Figure 7:
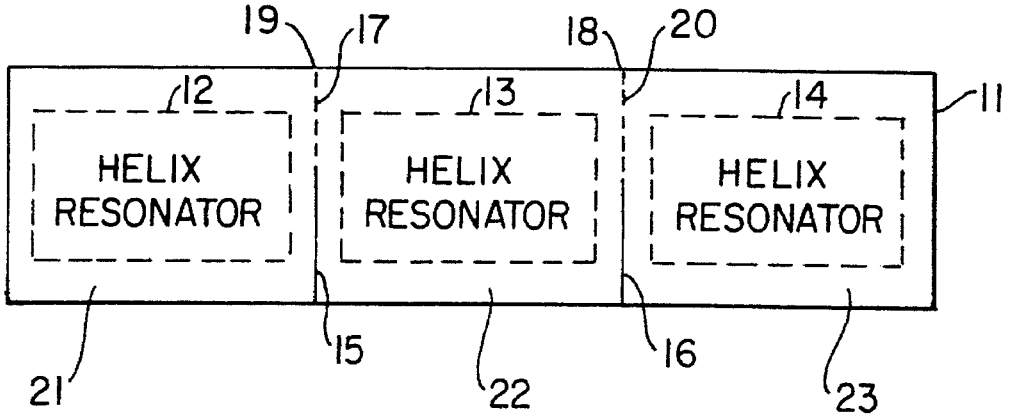
FIG. 7 is a schematic representation of a radio frequency filter housing in accordance with another embodiment of the invention.

When the filter housing is made in the way presented above, then each helix coil is placed in its own compartment and the bottom of the compartment is covered with a plate. In FIG. 7 the housing of a radio frequency filter is indicated by reference numeral 11. The housing 11 is divided by two partitions 15 and 16 in order to form three compartments 21, 22 and 23. Helix resonators 12, 13 and 14 are respectively disposed in the compartments 21, 22 and 23. Coupling apertures 17 and 18 according to the invention are provided in the partitions 15 and 16. Holes 19 and 20 are formed in the upper plane of the housing. A person skilled in the art will know different ways to assemble the filter, and the claims do not place any restrictions on these.

I claim:

1. A radio frequency filter comprising a housing having at least one partition for dividing the housing into compartments, the partition extending between outer walls of the housing, and a respective helix resonator disposed in each of the compartments, the partition having a coupling aperture that has a height and a width for coupling adjacent helix resonators to each other through the aperture, the coupling aperture having an open end at one of the outer walls of the housing and having two side edges and a bottom edge, the height of the coupling aperture being defined by the distance from the bottom edge to said one outer wall of the housing, and the width of the coupling aperture being defined by the distance between the two side edges, said aperture having smooth side edges extending along an entirety of the height, said one outer wall having an opening to the coupling aperture.

2. A radio frequency filter according to claim 1 wherein the opening in the outer wall of the housing is substantially circular.

3. A radio frequency filter according to claim 1, wherein the housing comprises as outer walls an upper face and first and second side faces transverse thereto the partition extending therebetween, the opening being located in the upper face and the coupling aperture opening to the upper face.

* * * * *